United States Patent [19]

Gunzel, Jr. et al.

[11] Patent Number: 4,527,740

[45] Date of Patent: Jul. 9, 1985

[54] HOSE-END ASPIRATOR SPRAYER

[75] Inventors: Rudolph M. Gunzel, Jr., Glendale; William J. Wichman, Glendora; Roy K. Fujitaki, Altadena, all of Calif.

[73] Assignee: Chevron Research Company, San Francisco, Calif.

[21] Appl. No.: 450,273

[22] Filed: Dec. 16, 1982

[51] Int. Cl.[3] ..... B05B 7/30

[52] U.S. Cl. ..... 239/318

[58] Field of Search ..... 239/318, 317, 310, 572, 239/304

[56] References Cited

U.S. PATENT DOCUMENTS

| | | | |
|---|---|---|---|
| 2,246,211 | 6/1941 | Kilich | 239/318 X |
| 2,388,445 | 12/1945 | Stewart | 239/318 |
| 3,253,788 | 5/1966 | McHugh et al. | 239/318 X |
| 3,632,046 | 1/1972 | Hengensbach | 239/318 |
| 3,940,069 | 2/1976 | Gunzel, Jr. et al. | 239/318 |
| 3,964,689 | 6/1976 | Horvath | 239/318 |
| 4,058,259 | 11/1977 | Schantz | 239/276 |

FOREIGN PATENT DOCUMENTS

| | | |
|---|---|---|
| 1319788 | 6/1973 | United Kingdom . |
| 1386186 | 3/1975 | United Kingdom . |
| 2018626A | 10/1979 | United Kingdom . |

*Primary Examiner*—Andres Kashnikow
*Assistant Examiner*—Kevin Patrick Weldon
*Attorney, Agent, or Firm*—Burns, Doane, Swecker & Mathis

[57] ABSTRACT

A hose-end sprayer includes a linearly actuated valve such as a poppet valve that is opened by means of pressure applied thereto from a pivoted lever. The lever and valve provide instant on and off action and one-handed control over the water flow. Pressurized water containing a mixed chemical is supplied to a spray defining nozzle in a closed system that maintains the water under full pressure until after it emerges from the nozzle. By preventing contact between the water and air until the spray pattern is formed, better definition of the pattern is obtained and nozzle drip is eliminated.

22 Claims, 18 Drawing Figures

HOSE-END ASPIRATOR SPRAYER

BACKGROUND OF THE INVENTION

The present invention relates to liquid sprayers and more particularly to sprayers of the aspirator type that proportionally mix a liquid with water under pressure and provide a spray of the liquid/water mixture.

Sprayers of this type are commonly employed to apply diluted solutions containing chemicals such as pesticides, fungicides, herbicides and fertilizers to lawns or garden foliage. Typically, sprayers of this type are attached to a garden hose that serves as a handle for the sprayer. The pressure of the water delivered through the hose is used to create a vacuum that causes the chemical to be aspirated into the water, to provide the diluted solution that is subsequently sprayed.

Different types of applications may have different requirements for the proportion of chemical that is mixed with the water, as well as the flow rate of the water, i.e. the number of gallons of water that are delivered per minute. For example, in lawn applications the desired mixture of water to chemical may be 60:1 and the flow rate might be 2.4 gallons/minute at a pressure of 50 psi. Garden sprayers may have a much higher mixture ratio of 24:1 but a lower flow rate that may be only 30% of that for lawn sprayers. In addition, the desired spray pattern may be different for various types of applications.

Consequently, sprayers for different types of applications may be constructed as separate units, each one being designed for the particular requirements of one application. Alternatively, a single sprayer can be designed for both lawn and garden applications, with appropriate controls for changing the flow rate, the water/chemical mixture ratio and the spray pattern. Examples of the latter type of sprayer are disclosed in U.S. Pat. Nos. 3,940,069 and 3,291,395. Basically, the sprayers disclosed in these patents include a rotatable control member that selectively positions different sized flowthrough bores and metering orifices in an operative position to control the water flow and mixing rates. In addition, they include a rotatable turret that enables different types of spray nozzles to be placed in fluid communication with the operative flowthrough bore to provide different spray patterns.

Although hose-end sprayers of the aspirator type are presently in widespread use and have met with a good deal of success, it is desirable to improve upon certain features thereof. More particularly, one limitation associated with heretofore known aspirator-type sprayers has been in the control that can be obtained over the spray pattern. In this context, a primary concern lies in the fact that these sprayers tend to drip during the spraying operation, either from the end of the nozzle through which the spray is emitted or at the interface of components in the sprayer. Since the chemicals that are often applied with these sprayers can be caustic or otherwise potentially harmful, any dripping thereof on the clothes of the person using the sprayer, for example, is highly undesirable.

In addition, misting or spurious emission of droplets can occur at the edges of the spray pattern. These types of emissions are undesirable from the standpoint that they can result in the deposit of the chemical in areas where it is not desired. For example, a strong pesticide might be deposited on a delicate ornamental plant located adjacent a shrub to be treated.

Further drawbacks associated with the limit on the control that could previously be obtained over the spray pattern relate to the non-uniformity of the spray and the variation in droplet size. Typically, larger droplets and heavier spray concentration would be found at the center of the pattern, resulting in an uneven application.

It has been determined that these limitations associated with the control of the emissions from the sprayer are in large part due to the fact that the liquid is vented to atmospheric pressure before the spray pattern is formed. Once the water and the liquid chemical are mixed through the action of the aspirator, they flow through a control bore, sometimes referred to as an eductor bore, while still under pressure. In the prior types of sprayers, a liquid stream is emitted from the bore into a chamber or other open space at atmospheric pressure, where the stream is allowed to expand. Thereafter, the stream strikes a deflector surface which forms it into the desired pattern. Since the pressure on the stream is reduced and it comes into contact with air prior to the time that it reaches the deflector surface, the degree of control that can be exercised over the spray pattern is practically limited.

Another feature of aspirator-type sprayers upon which it is desired to improve relates to the convenience and operating control that can be obtained with such devices. For example, in the sprayers illustrated in the previously noted patents, the spray of water is turned on and off at the sprayer through rotation of the control member about an axis that is parallel to the spray axis. This control of the spray typically involves a two-handed operation, since one hand must grasp the hose connected to the sprayer (or an extension of the sprayer that connects to the hose) to support and hold it steady while the other hand turns the control member.

Other sprayers have different types of control actuators but still require the same basic operation of rotating or pivoting the control through an arc to turn the spray on or off. This action can be somewhat cumbersome, and can cause the spray to be deposited in areas other than where it is desired. In other words the operator may point the sprayer in a direction other than where the spray is initially desired in order to be able to conveniently grasp it and rotate the control member.

Each of these rotatable actuators provides only two modes of control over the spray, i.e. on or off. They remain in either the on or off position unless actuated by the operator. If the person operating the sprayer should happen to drop the sprayer, trip over an object, or otherwise momentarily lose control of the sprayer while it is operating, the spray could be emitted in an unwanted and potentially harmful direction. Additionally, the rotary type of actuator does not provide control over the water pressure or the flow rate when the sprayer is turned on. Typically, this type of control must be obtained through a faucet or the like that regulates the water entering the hose.

OBJECTS AND BRIEF SUMMARY OF THE INVENTION

It is therefore a general object of the present invention to provide a novel hose-end sprayer of the aspirator type that affords instantaneous and precise control over the application of a chemical agent and that substantially reduces unwanted drip, misting and spurious emissions.

It is a more specific object of the present invention to provide a hose-end sprayer that maintains a stream of mixed water and other liquid under pressure until the stream is emitted from the sprayer in a desired pattern, to thereby provide improved definition of the spray pattern.

It is another object of the present invention to provide a hose-end sprayer with a novel flow-control valve and valve actuator that offer simple, instantaneous and effective control in turning the spray on and off.

It is a further object of the present invention to provide a novel valve system for an aspirator sprayer that offers automatic shut-off, in case of loss of control by the person operating the sprayer.

It is yet another object of the present invention to provide a novel sprayer that allows single-handed control of the on/off function of the sprayer.

In accordance with one aspect of the present invention, some of these objects, and their attendant advantages, are achieved with a closed system for conducting the stream of water and other liquid from the eductor bore to the output end of the spray nozzle. Rather than emitting from the eductor bore into an open chamber at atmospheric pressure, the stream of water and other liquid emerges from the bore and comes into direct contact with the nozzle that defines the spray pattern. Thus, the spray pattern is determined while the stream is still under pressure and before it comes into contact with air particles. This feature enables a better definition of the stream pattern to take place, as well as eliminates drip and increases uniformity of distribution and droplet size.

Certain others of the foregoing objects are achieved by other features of the present invention. By regulating the flow of water through the sprayer with a linearly actuated valve, e.g. a poppet valve, rather than a rotary valve, instantaneous control over the water flow is possible. When the poppet valve is biased to a normally closed position by a spring or the water pressure, or preferably both, the sprayer will be automatically turned off should the person operating it ever be thrown off balance and lose his grip on the sprayer. Actuation of the poppet valve with a linearly actuated lever located adjacent the hose connection provides for effective one-handed control over the sprayer. The instantaneous control of the spray provided with this arrangement, in combination with the well-defined spray pattern, enables precise application of the chemical to be obtained. Thus the sprayer can be pointed directly at the spot where the application is desired and then actuated to produce the spray at only the intended place. This feature is of particular significance where spot spraying of a chemical is desired, for example coverage of only a portion of ornamental foliage without saturation of the entire plant. In addition, the mechanical advantage that is obtained with the lever enables easier control of the water flow rate to be obtained.

Further understanding of these and othe features of the present invention, and appreciation of the advantages that they offer, can best be obtained from a perusal of the following description of preferred embodiments of the invention that are illustrated in the accompanying drawings.

DETAILED DESCRIPTION

The features of the present invention are discussed hereinafter with particular reference to their incorporation in separate lawn and garden sprayers, to facilitate an understanding thereof. It will be appreciated by those having skill in the sprayer art that the specific applications of the invention are not so limited, but rather are applicable to a number of different types of hose-end sprayers.

Figure 1:
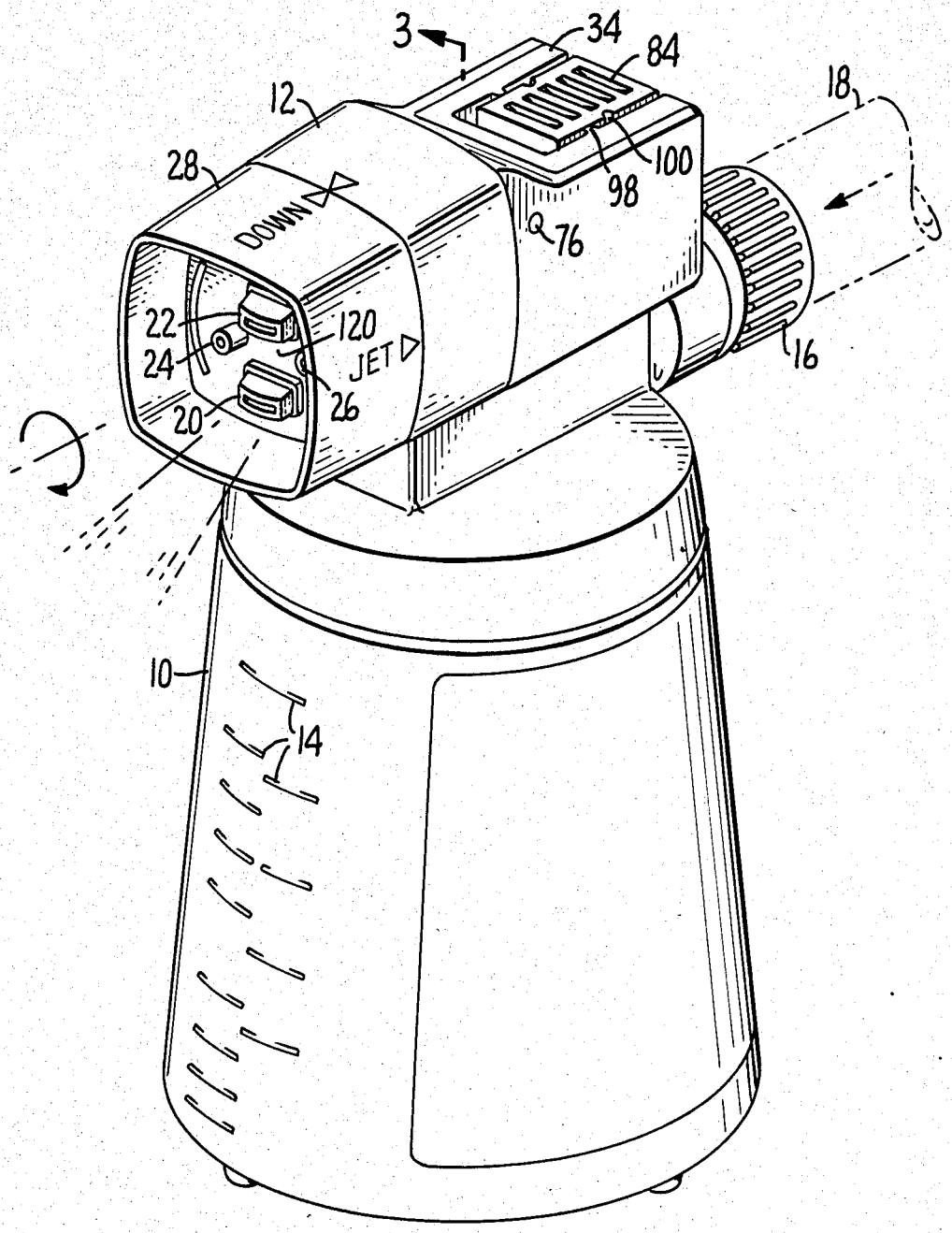
FIG. 1 is a perspective view of a hose-end sprayer that is designed for garden type applications and that implements the principles of the present invention.

Referring to FIG. 1, an aspirator sprayer constructed in accordance with the present invention includes a container 10 that is coupled, for example by means of threads, to a sprayer housing 12. The container 10 houses the pesticide, fungicide, herbicide, fertilizer or other liquid chemical to be applied. Typically, the chemical might be poured into the container in a highly concentrated form, and then water added to dilute it to the proper level of concentration. To facilitate measurement of the chemical and/or the added water, the side of the container 10 can be provided with appropriate markings 14 to indicate various volumes. These markings could be in the form of raised projections, or ribs, on the container, for example.

The sprayer housing 12 includes a swivel nut 16 at one end for connection to a hose 18. Pressurized water supplied by the hose flows through internal passages in the housing, causing the liquid chemical in the container 10 to be drawn up into the water stream. The mixture of water and chemical is emitted from the other end of the sprayer through a nozzle 20.

In the embodiment of the garden type sprayer illustrated in FIG. 1, four nozzles 20–26 are recessed within a rotatable turret or shroud 28. The nozzle 20 is illustrated in the operative position, to provide a downwardly directed fan-shaped spray, for application of the chemical to low shrubs and the like. By rotation of the shroud 180°, the nozzle 22 can be brought into operative position to provide a similarly shaped spray that is upwardly directed, for application to higher shrubs and trees, for example. The nozzles 24 and 26 can be rendered operative to provide jet stream types of sprays by appropriate rotation of the shroud. The peripheral extension of the shroud beyond the nozzles protects the nozzles and reduces the possibility that the chemical solution would become contaminated by foreign particles entering them.

Figure 2:
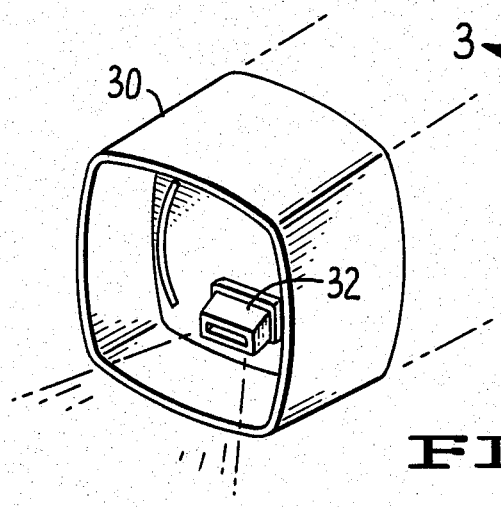
FIG. 2 is a perspective view of the nozzle end of a sprayer designed for lawn-type applications.

A variety of different types of sprays is not normally required for lawn applications. Consequently, a shroud 30 designed for a lawn sprayer might only have one nozzle 32, as illustrated in FIG. 2. This nozzle would be designed to provide a downwardly directed fanshaped spray, with perhaps a wider area of coverage than the nozzle 20 for the garden sprayer. In the case where only one nozzle is provided on the shroud 30, the latter need not be rotatable with respect to the housing 12. However, it will be appreciated that the shroud 30 for the lawn sprayer could be made rotatable and include two or more nozzles. One of the nozzles could provide a very well-defined area of coverage and another would give more of a broadcast type of application, for application of different types of chemicals for example.

Referring again to FIG. 1, control of the flow of water from the hose is provided at the sprayer through a lever 34. In hose-end sprayers of the type illustrated in FIG. 1, the hose 18 serves as a handle for supporting the sprayer and controlling the direction of the spray. Alternatively, an extension (not shown) of the housing 12, the remote end of which is connected to the hose, can serve as a handle. In either case, the lever 34 is located adjacent and slightly above the hose connector or portion of the housing that is grasped as a handle. With this arrangement, the lever can be easily depressed by the thumb of the hand that grasps the hose, to permit water to flow through the housing. Thus, simple one-handed control of both the direction of the spray and the flow of water is provided.

Figure 3:
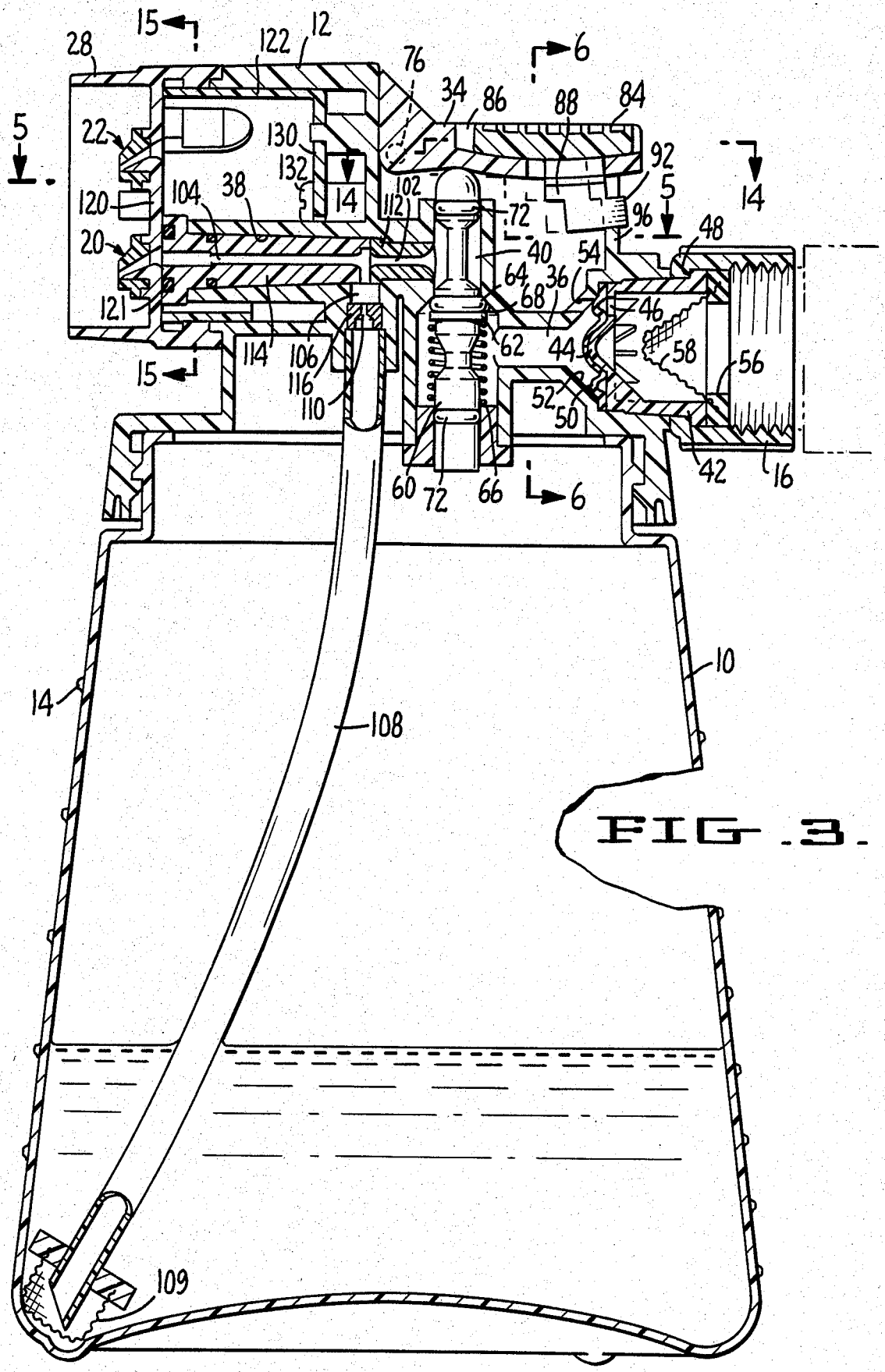
FIG. 3 is a cross-sectional side view of the sprayer, taken along the section line 3—3 of FIG. 1.
Figure 4:
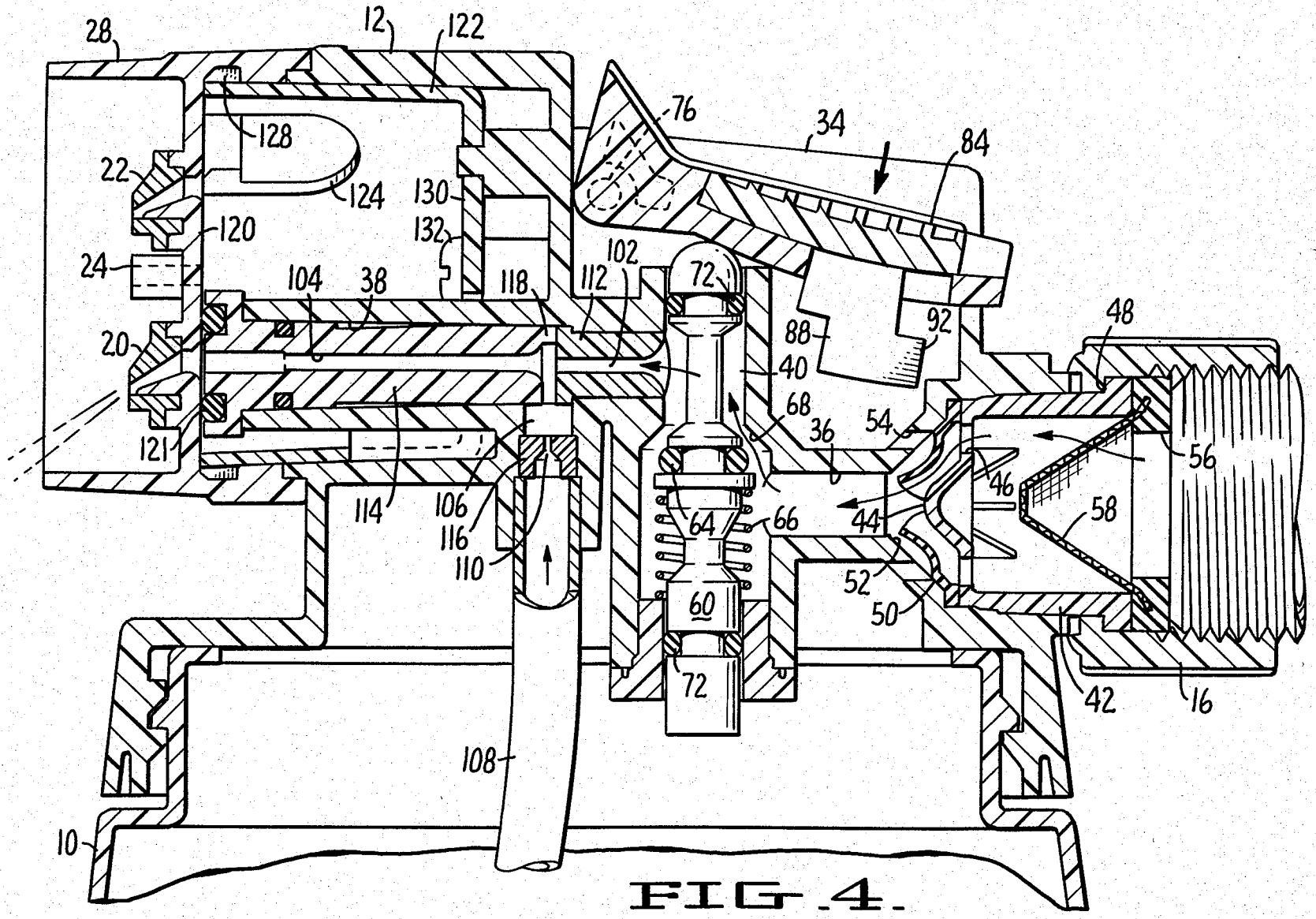
FIG. 4 is a detailed cross-sectional side view of the sprayer unit, illustrating it in an actuated mode of operation.

Referring now to FIGS. 3 and 4, the structure of the sprayer housing and associated components is illustrated in greater detail. The housing 12 includes two generally horizontal bores that define an inlet passage 36 and an outlet passage 38. These two passages are interconnected by a generally vertical passage 40 that defines a valve chamber.

The inlet passage 36 is in fluid communication with a hose attached to the connector 16. An anti-siphon device is disposed in the passage to prevent a flow of liquid from the housing into the hose if a sudden drop in the hose water pressure should occur. The anti-siphon device includes a cylindrical sleeve 42 having a conically shaped transverse wall 44 at the interior end thereof. The wall includes a plurality of apertures 46 disposed in a circular pattern. The outer end of the sleeve has a circumferential shoulder 48 which serves as a coupling collar for the swivel nut 16.

A diaphragm 50 with a slitted dome overlies the apertures 46 in the wall 44. The diaphragm includes two concentric circular convolutions that provide flexibility. In operation the diaphragm normally lies in the position illustrated in FIG. 3 to close off the apertures 46. Under positive pressure from water in the hose 18, the slits in the dome enable the diaphragm to open outwardly and lie against a contoured surface 52 in the passage 36, as illustrated in FIG. 4. The water can therefore flow through the apertures 46 and into the passage. If the water pressure in the hose should suddenly drop, the diaphragm 50 will return to the position illustrated in FIG. 3. This action prevents liquid in the passage 36 (that might contain chemicals from the container 10) from entering the hose. In the event that the diaphragm 50 does not completely seat against the wall 44, apertures 54 in the surface 52 allow air to be drawn into the passage 36 to prevent the reduced pressure in the hose from "siphoning" any liquid (which may be in the passage 36) into the hose.

A rubber washer 56 can be inserted in the swivel nut 16 to provide a fluid tight coupling between the hose and the sprayer. A strainer 58, such as a conical screen, can be integrally attached to washer to prevent large particles of foreign matter from entering the sprayer.

A poppet valve is disposed in the generally vertical passage 40 that connects the inlet and outlet passages 36 and 38. The valve includes a generally cylindrical valve stem 60 having an annular shoulder 62 disposed at the middle thereof and an O-ring 64 located immediately above the shoulder. A spring 66 surrounding the lower portion of the valve stem and resting against the shoulder normally urges the stem in an upward direction. This bias provided by the spring causes the O-ring 64 to seat against a valve seat formed by an annular shoulder that is defined by a tapered surface 68 in the vertical passage 40. The spring is retained in place by a bushing 70 disposed in the bottom of the passage. Suitable O-rings 72 on the valve stem provide a fluid-tight seal so that liquid cannot escape through the top or bottom of the passage.

In the position shown in FIG. 3, the poppet valve is closed to prevent water supplied by the hose from entering the outlet passage 38. To open the valve, the valve stem is urged downwardly against the bias of the spring and the pressure of the water by means of the lever 34, as illustrated in FIG. 4. This action establishes fluid communication between the inlet and outlet passages.

Figure 14:
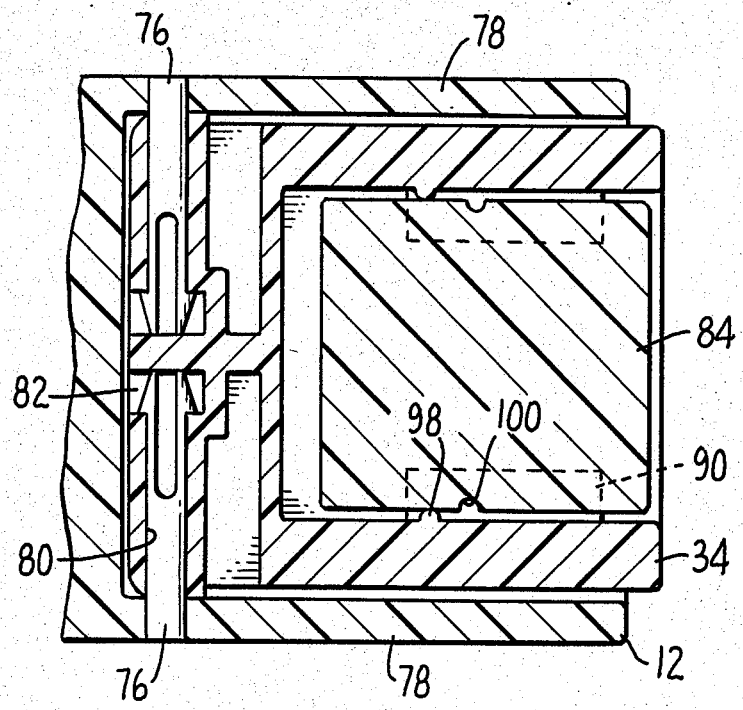
FIG. 14 is a cross-sectional top view of the actuating lever portion of the sprayer, taken along the section line 14—14 of FIG. 3.

The lever 34 is pivotally attached at one end thereof to the housing 12. As best illustrated in FIG. 14, this pivotal attachment can be provided by means of barbed pins 76 inserted into the lever through vertical walls 78 in the housing. Two coaxial bores 80 in the lever accommodate the pins. An enlarged recess 82 is provided at the interior end of each bore to receive the barbed end of one of the pins, and lock the pin in place.

The upper end of the valve stem 60 engages the underside of the lever 34 at a point displaced from its pivot axis. To provide for good sliding contact between the stem and the lever, the upper end of the stem can have a hemispherical shape. The upper side of the lever is engaged by the thumb of the user near the end of the lever remote from the pivot axis. Since the downward force applied to the lever is farther from the pivot axis than the point of engagement with the valve stem, the lever provides a mechanical advantage. This feature enables control to be obtained over the downward movement of the valve stem, and hence the amount of water flowing through the valve. The degree of control afforded over the flow rate is determined in part by the angle of the tapered surface 68.

The bottom of the valve stem 60 projects through the bottom of the bushing 70. Thus, if the valve should become lodged in the open position, it can be returned to the closed position by applying force to the stem from the underside of the housing. Alternatively, the valve stem can be fixedly attached to the lever 34 by any suitable connection that allows for limited pivotal movement between them. With such an arrangement, a stuck valve can be closed by pulling up on the lever.

Figure 6:
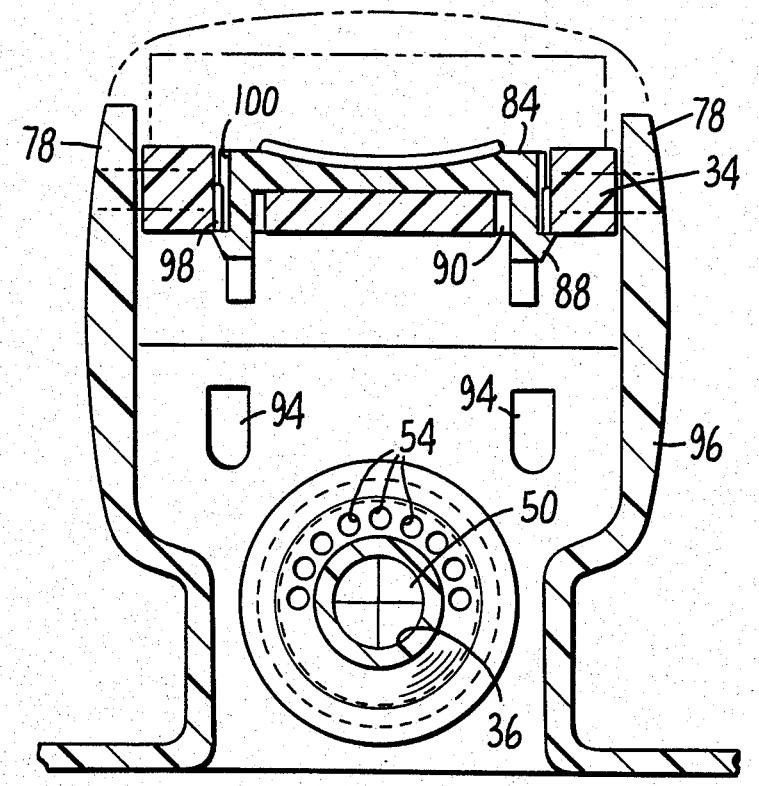
FIG. 6 is a cross-sectional front view of the sprayer, taken along the section line 6—6 of FIG. 3.
Figure 7:
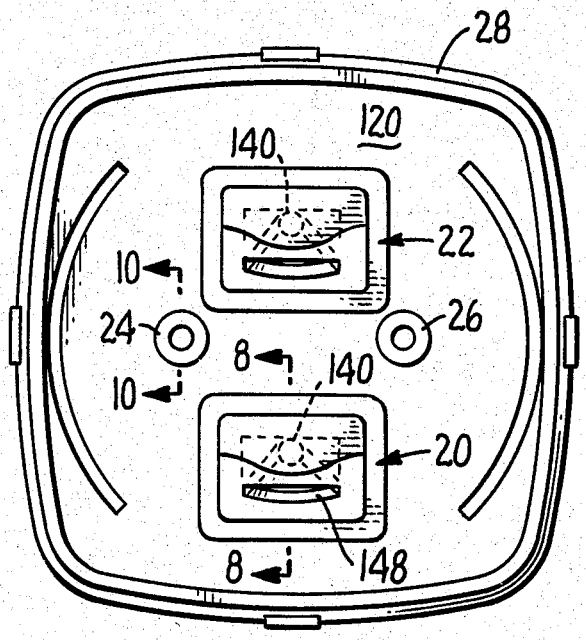
FIG. 7 is a detailed front view of a sprayer turret or shroud for garden type applications.

In some situations it may be desirable to lock the valve in an open position, for example to eliminate the need to hold the lever down during sustained applications. To this end, the lever is provided with a locking device comprising a slide 84 that is accommodated within a rectangular recess 86 in the top of the lever. The slide includes two downwardly extending legs 88 that pass through slots 90 in the lever 34. As best illustrated in FIG. 6, a shoulder on the outside surface of each leg engages the underside of the lever to maintain the slide in place. A rearwardly extending projection 92 is located at the bottom of each leg. When the lever is in its lowest position, i.e. the valve is fully opened, rearward movement of the slide 84 causes the projections 92 to engage slots 94 in the rear transverse wall 96 of the housing (FIG. 6). This engagement keeps the valve open until the slide is returned to the forward position. To maintain the slide normally in the forward position, suitable detents 98 can be located on the sides of the recess 86 in the lever, and corresponding notches 100 can be provided in the slide (see FIG. 14).

The outlet passage 38 has two coaxial bores of different diameters. The upstream bore 102, referred to as the motive bore, has a diameter that determines the maximum flow rate of the sprayer. To prevent turbulence in the water flowing through the motive bore, the upstream end thereof has a radiused edge to provide an inlet area of increased diameter.

The eductor bore 104 disposed downstream of the motive bore has a slightly larger diameter than the motive bore. When water under pressure flows through the motive bore 102 into the eductor bore 104, a vacuum is created at their junction due to the difference in diameters. The magnitude of the vacuum is determined by the ratio of the two diameters. This vacuum is used to aspirate the liquid in the container 10 into the water stream. To this end, the outlet passage 38 is intersected by a second generally vertical passage 106. A tube 108 extends between the passage 106 and the bottom of the container 10 to cause the liquid in the container to be drawn up into the water stream. A strainer 109 at the bottom of the tube prevents particulate matter from entering the sprayer. A metering orifice 110 at the top of the tube 108 regulates the amount of liquid from the container that enters the water stream, i.e. it controls the mixture ratio.

As illustrated in FIGS. 3 and 4, each of the motive and eductor bores 102 and 104, and the metering orifice 110, are provided by inserts 112, 114 and 116 located in the respective passages 38 and 106. Each insert can be properly located within its passage by means of suitable positioning shoulders in the passages. The eductor insert 114 is spaced from the motive insert 112 by lugs 118 (FIG. 4) at the upstream end of the eductor insert. This spacing provides an opening through which liquid from the container can enter the water stream.

Figure 16:
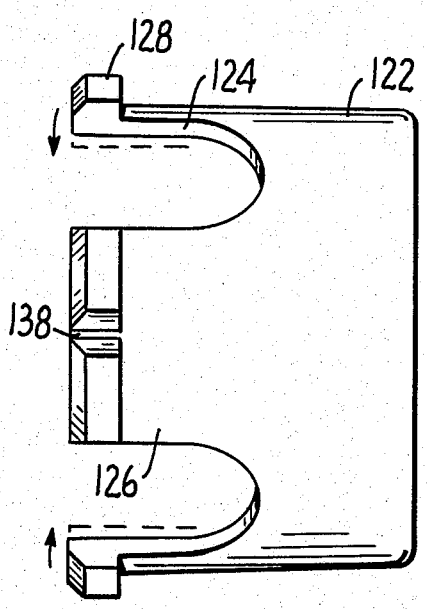
FIG. 16 is a plan view of the shroud retainer.

The downstream end of the eductor insert 114 abuts a central transverse wall 120 of the shroud 28. An O-ring 121 in the insert provides a fluid-tight coupling between the insert and the shroud. The shroud is rotatably mounted on the sprayer by means of a retainer 122 attached to the housing. The retainer is best illustrated in FIG. 16. It is cylindrical in shape, and has four U-shaped slots 124 extending from one end to approximately the middle thereof. These slots result in four radially flexible fingers 126 being formed. Each finger has a flange 128 defining a shoulder on the outside edge thereof. A transverse wall 130 at the other end of the retainer provides a mounting surface by which the retainer can be attached to the sprayer housing, for example by means of screws 132 (FIG. 3).

Figure 5:
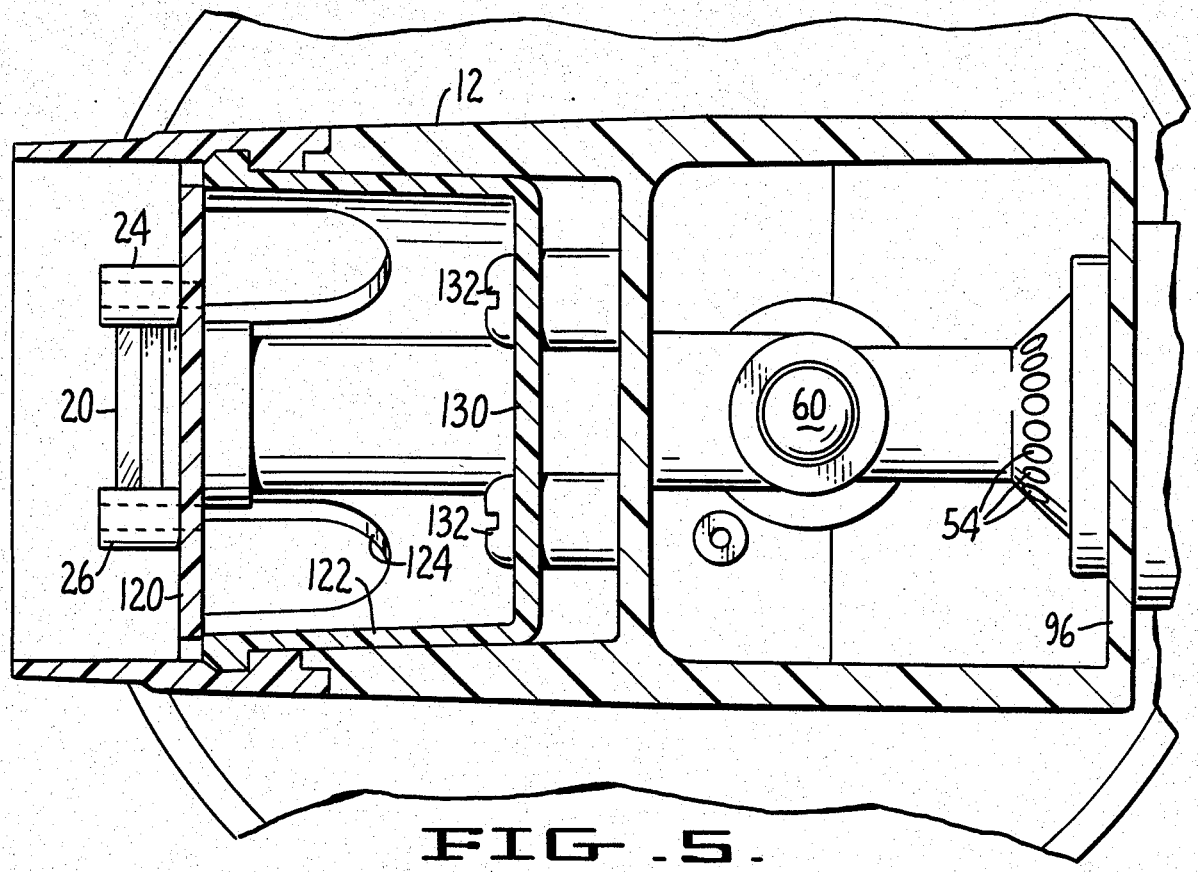
FIG. 5 is a cross-sectional top view of the sprayer, taken along the section line 5—5 of FIG. 3.
Figure 15:
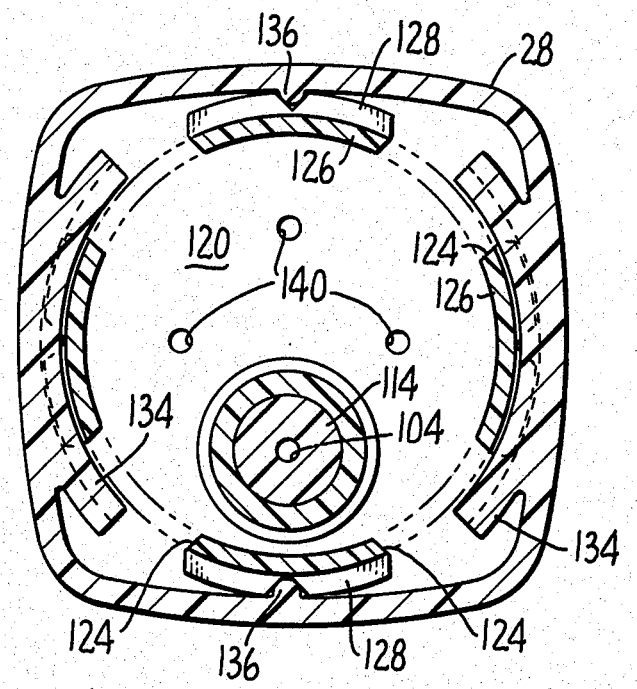
FIG. 15 is a cross-sectional back view of the sprayer shroud, taken along the section line 15—15 of FIG. 3.

Referring to FIG. 15, arc-shaped projections 134 are located on the interior of two opposite walls of the shroud. An arc-shaped groove in each projection accommodates the flange 128 on the fingers 126 of the retainer 122, to thereby hold the shroud on the sprayer, as best illustrated in FIGS. 3–5. A circular shoulder 135 on the housing 12 engages the shroud and defines its axis of rotation. Detents or ribs 136 on the other two walls of the shroud and corresponding notches 138 in the fingers 128 provide for suitable indexing of the shroud as it is rotated relative to the housing. The indexing assures that one of the outlet holes 140 in the shroud wall 120 will be aligned with the eductor bore 104.

As an alternative to the arrangement shown in the drawings, the shroud can be attached to the housing by means of a screw that passes through the center of the transverse wall 120 of the shroud and into the housing. Such a screw would define the axis of rotation for the shroud.

The outlet holes 140 in the shroud wall 120 have a diameter that is substantially the same or only slightly larger than that of the eductor bore 104. Therefore, as the fluid stream exits the eductor bore and passes through the shroud wall, it undergoes almost no reduction in pressure. To decrease the possibility of turbulence in the fluid stream at this point, the upstream end of each hole 140 has a radiused edge.

Figure 9:
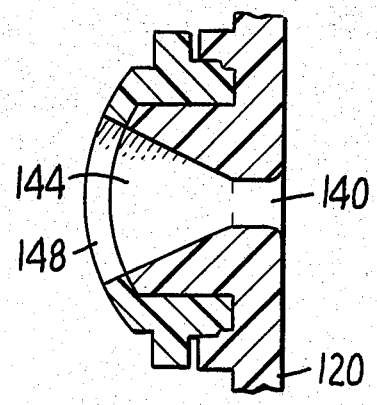
FIG. 9 is a cross-sectional top view of the nozzle, taken along the section line 9—9 of FIG. 8.
Figure 8:
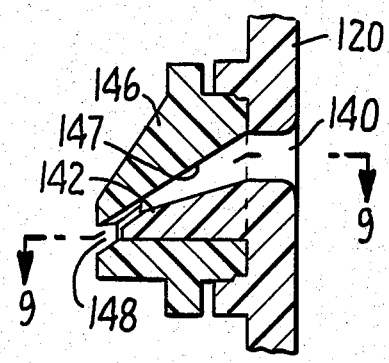
FIG. 8 is a cross-sectional side view of a nozzle for downwardly directed sprays, taken along the section line 8—8 of FIG. 7.

Referring to FIGS. 7–10, the nozzles 20–26 are integral with the central wall 120 of the shroud. To facilitate molding of the shroud, the two nozzles 20 and 22 for producing the fan-shaped spray can be formed by two parts. The bottom and sides of each of these nozzles is defined by a lip 142 projecting from the wall 120. As best illustrated in FIG. 9, the lip has a fan-shaped recess 144 whose narrow end is contiguous with the hole 140. A wedge-shaped cap 146 is fitted over the lip 142 and adhered to the wall 120. The cap defines a deflector surface 147 at the top of the nozzle, and has a rectangular slot 148 at the front thereof, from which the spray is emitted.

Figure 17:
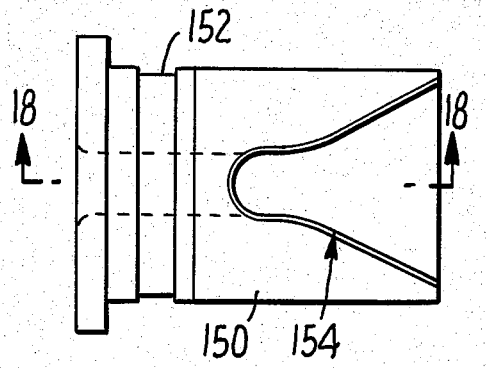
FIG. 17 is a top view of an alternative embodiment of a nozzle member.
Figure 18:
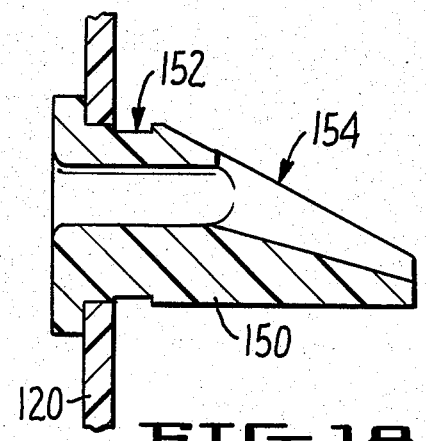
FIG. 18 is a sectional side view of the alternate nozzle lip member.

As an alternative to adhering the cap 146 to the wall 120, for example by sonic welding, it can be snap-fit into place. Referring to FIGS. 17 and 18, the lip 142 can be provided by a flanged insert 150 that passes through the wall 120. A groove 152 in the portion of the insert forward of the wall 120 accomodates a corresponding lug or finger on the cap (not shown), to hold both of them in place. To insure a fluid-tight seal between the insert and the cap, an upstanding lip 154 can be provided around the edge of the insert where it engages the cap.

Figure 10:
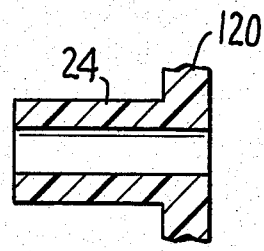
FIG. 10 is a cross-sectional side view of a nozzle for providing a jet stream output, taken along the section line 10—10 of FIG. 7.

The jet nozzles 24 and 26 are of relatively simple construction, and comprise tubular projections integral with the shroud wall 120, as illustrated in FIG. 10.

Figure 13:
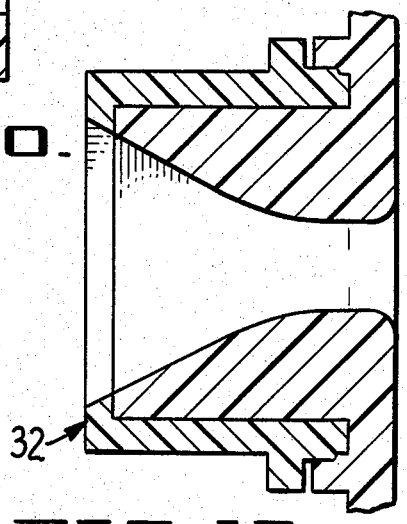
FIG. 13 is a cross-sectional top view of the lawn spray nozzle, taken along the section line 13—13 of FIG. 12.
Figure 11:
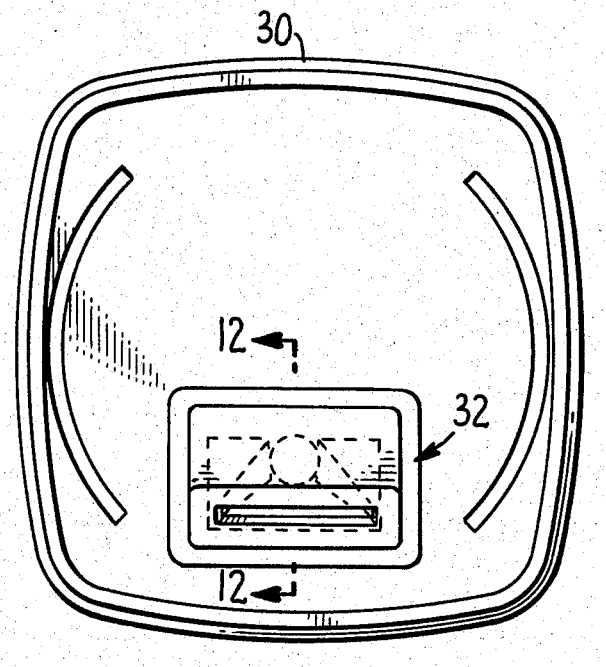
FIG. 11 is a detailed front view of a sprayer shroud for lawn type applications.
Figure 12:
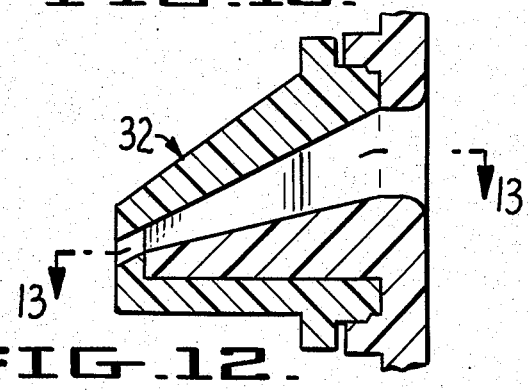
FIG. 12 is a cross-sectional side view of the lawn spray nozzle, taken along the section line 12—12 of FIG. 11.

The lawn sprayer shroud 30 and nozzle 32 illustrated in detail in FIGS. 11–13 are generally similar to the shroud 28 and nozzle 20 for the garden sprayer, with the exception that only one nozzle is provided, which is suitably dimensioned for the requirements of lawn type applications.

The production of the spray pattern takes place in a closed system. In other words, the water stream containing the mixed chemical is maintained under substantially full pressure, i.e. the pressure at which the water enters the sprayer housing, until it exits the nozzle. It is not vented to atmosphere or otherwise contacted with air particles after it emerges from the eductor bore and prior to the time it is formed into the spray pattern. It has been found that this type of system produces a well-defined and precisely controlled spray pattern that has uniform distribution and controlled droplet size.

Summarizing the operation of the sprayer, water under pressure from the hose 18 enters the inlet passage 36 and is contained within this passage and the lower portion of the valve chamber formed by the passage 40. When the user depresses the thumb lever 34, the poppet valve opens and allows water to flow into the upper part of the passage 40 and into the bores of the outlet passage 38. The one-handed control that is afforded enables the sprayer to be easily and instantly turned on and off while being pointed directly at the area of the desired application, thus giving precise application control. The valve can be locked in the fully open position by engaging the leg projections 92 of the slide 84 in the slots 94 in the rear wall 96 of the housing. Assuming the lever is not locked, any release of the force on the lever, for example if the sprayer is dropped, will cause the poppet valve to close automatically under the combined forces of the water pressure and the spring 66. Thus, a potentially harmful spray will not be emitted when the sprayer is not under control.

As the pressurized water flows from the motive bore 102 to the eductor bore 104, their relative difference in size creates a vacuum. This vacuum causes the liquid in the container 10 to be aspirated up into the water stream. In this regard, the relative sizes of the motive bore, the eductor bore, and the metering orifice are preferably such that the vacuum increases proportionally with the water flow rate, so that the mixture ratio remains constant over a wide range of water pressures. One example of a lawn sprayer having a maximum flow rate of 2.9 gal/min at a pressure of 55 psi and a mixture ratio of 59:1 that achieves the foregoing operation has a motive bore diameter of 0.120 inch, an eductor bore diameter of 0.140 inch and a metering orifice diameter of 0.029 inch. A garden sprayer having a flow rate of 0.76 gal/min and a mixture ratio of 23:1 can have a motive bore diameter of 0.059 inch, an eductor bore diameter of 0.073 inch and a metering bore diameter of 0.021 inch. These dimensions have been found to provide a substantially constant mixture ratio over a range of 25–75 psi, which is the range normally encountered in most home situations.

The liquid stream emerging from the eductor bore passes directly into the nozzle on the shroud 28 while still under full pressure. In the nozzle, it is formed into the desired spray pattern before it is allowed to expand under contact with air.

It will be appreciated that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalency of the claims are therefore intended to be embraced therein.

What is claimed is:

1. An aspirator sprayer unit adapted to be connected to a hose, for mixing a liquid with pressurized water from the hose and providing a spray of the mixture, comprising:

a container for housing the liquid to be mixed with the water;

a sprayer housing having a connector for attachment to a hose, an inlet passage in fluid communication with the connector to receive pressurized water from a hose attached thereto, and an outlet passage with a motive bore having a first diameter and an eductor bore disposed immediately downstream of said motive bore and having a second diameter larger than said first diameter to thereby create a vacuum when pressurized water flows through said bores;

a metering bore in fluid communication with both said container and said outlet passage for admitting fluid from said container into said outlet passage at a predetermined rate when a vacuum is created in said outlet passage; and a nozzle means disposed at the end of said outlet passage that is remote from said motive bore, said nozzle being in direct fluid communication with the downstream end of said eductor bore, without any intervening chambers, to thereby maintain the liquid in said nozzle under pressure until the liquid exits from said nozzle.

2. The sprayer unit of claim 1 wherein said nozzle includes a deflector surface that is contacted by liquid at substantially the same pressure as the liquid in said eductor bore.

3. The sprayer unit of claim 1 including a turret mounted on said housing, wherein said nozzle is mounted on said turret, and further including a second nozzle mounted on said turret, said turret being rotatable to selectively place one of said nozzles in fluid communication with said outlet passage.

4. The sprayer unit of claim 1 wherein said nozzle produces a fan-shaped spray and has a relatively narrow opening at the end adjacent said eductor bore and a relatively wide opening at the output end thereof.

5. A hose-end aspirator sprayer unit for mixing a liquid with pressurized water from a hose and providing a spray of the mixture, comprising:

a container for housing the liquid to be mixed with the water;

a sprayer housing having a connector for attachment to a hose, an inlet passage in fluid communication with the connector to receive pressurized water from a hose attached thereto, and an outlet passage with a motive bore having a first diameter and an eductor bore disposed immediately downstream of said motive bore and having a second diameter larger than said first diameter to thereby create a vacuum when pressurized water flows through said bores;

a valve providing selective fluid communication between said inlet and outlet passages;

a metering bore in fluid communication with both said container and said outlet passage for admitting fluid from said container into said outlet passage at a predetermined rate when a vacuum is created in said outlet passage; and a nozzle in fluid communication with said eductor bore, said nozzle having means for forming liquid emerging from said eductor bore into a predetermined spray pattern while said liquid is under substantially the same pressure as liquid in said eductor bore.

6. The sprayer unit of claim 5 said eductor bore and said nozzle are included in a closed fluid system wherein liquid emerging from said eductor bore and flowing into said nozzle is not contacted by air until said liquid is emitted from said nozzle.

7. An aspirator sprayer unit adapted to be connected to a hose, for mizing a liquid with pressurized water from the hose and providing a spray of the mixture, comprising:

a container for housing the liquid to be mixed with the water;

a sprayer housing having a connector for attachment to a hose, an inlet passage in fluid communication with the connector to receive pressurized water from a hose attached thereto, and an outlet passage with a motive bore having a first diameter and an eductor bore disposed immediately downstream of said motive bore and having a second diameter larger than said first diameter to thereby create a vacuum when pressurized water flows through said bores;

a linearly actuated valve disposed between said inlet and outlet passages, said valve being biased to a position to normally close said inlet passage off from said outlet passage;

a pivoted lever operatively connected to said valve, said lever being normally biased to a first position by said valve and being movable to a second position under force to open said valve and provide fluid communication between said inlet and outlet passages;

a metering bore in fluid communication with both said container and said outlet passage for admitting fluid from said container into said outlet passage at a predetermined rate when a vacuum is created in said outlet passage; and a nozzle means disposed at the end of said outlet passage that is remote from said motive bore to form the liquid into a desired spray pattern, said nozzle being in direct fluid communication with the downstream end of said eductor bore without any intervening chambers, to thereby form the liquid in the nozzle into the desired spray pattern while it is maintained under substantially the same pressure as the liquid in the eductor bore.

8. The sprayer unit of claim 7 wherein said inlet and outlet passages are generally parallel to one another, and said valve is disposed in a passage that is generally perpendicular to said inlet and outlet passages and which provides fluid communication between said inlet and outlet passages.

9. The sprayer unit of claim 7 wherein said valve is a poppet valve.

10. The sprayer unit of claim 7 further including anti-siphon means disposed in said inlet passage for enabling liquid to flow in only one direction from said connector to said inlet passage.

11. The sprayer unit of claim 7 wherein said motive bore has a substantially uniform diameter along its length and an increased diameter provided by a divergent curved surface at one end thereof.

12. The sprayer unit of claim 7 wherein said lever pivots about a horizontal axis and is normally biased to an upper position by said valve and actuated by downward pressure to open said valve.

13. The sprayer unit of claim 7 wherein said nozzle includes a deflector surface that is contacted by liquid at substantially the same pressure as the liquid in said eductor bore.

14. The sprayer unit of claim 7 including a turret on said housing, wherein said nozzle is mounted on said turret, and further including a second nozzle mounted on said turret, said turret being rotatable to selectively place one of said nozzles in fluid communication with said outlet passage.

15. The sprayer unit of claim 7 wherein said nozzle produces a fan-shaped spray, and has a relatively narrow opening at the end adjacent said eductor bore and a relatively wide opening at the output end thereof.

16. The sprayer unit of claim 7 wherein said lever is disposed above and adjacent to said hose connector so that when a hose attached to the unit is grasped as a handle the lever can be actuated by the thumb of a hand grasping the hose.

17. The sprayer unit of claim 7 further including means for locking said lever in said second position.

18. The sprayer unit of claim 17 wherein said locking means includes a slide disposed on said lever and having a projection for engagement with a detent in said sprayer housing.

19. The sprayer unit of claim 7 wherein said motive bore is provided by an insert disposed in said outlet passage.

20. The sprayer unit of claim 19 wherein said eductor bore is provided by a second insert disposed in said outlet passage.

21. The sprayer unit of claim 20 wherein said metering bore is provided by an insert disposed in said sprayer housing adjacent the junction of said motive and eductor bores.

22. The sprayer unit of claim 20 further including means for spacing said inserts to provide fluid communication between said motive and eductor bores and said metering bore.

* * * * *